US010793991B2

(12) United States Patent
Mazzon

(10) Patent No.: US 10,793,991 B2
(45) Date of Patent: Oct. 6, 2020

(54) HOME LAUNDRY WASHING MACHINE AND METHOD FOR CONTROLLING THEREOF

(71) Applicant: Electrolux Appliances Aktiebolag, Stockholm (SE)

(72) Inventor: Andrea Mazzon, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 166 days.

(21) Appl. No.: 16/083,175

(22) PCT Filed: Jan. 30, 2017

(86) PCT No.: PCT/EP2017/051938
§ 371 (c)(1),
(2) Date: Sep. 7, 2018

(87) PCT Pub. No.: WO2017/153091
PCT Pub. Date: Sep. 14, 2017

(65) Prior Publication Data

US 2019/0075999 A1 Mar. 14, 2019

(30) Foreign Application Priority Data

Mar. 11, 2016 (EP) ..... 16159779

(51) Int. Cl.
*D06F 39/00* (2020.01)
*D06F 34/28* (2020.01)
(Continued)

(52) U.S. Cl.
CPC ..... *D06F 39/007* (2013.01); *D06F 34/28* (2020.02); *D06F 35/005* (2013.01);
(Continued)

(58) Field of Classification Search
CPC ..... D06F 34/28; D06F 35/005; D06F 35/006; D06F 39/007; D06F 39/08; D06F 39/083; D06F 39/088
See application file for complete search history.

(56) References Cited

U.S. PATENT DOCUMENTS 3,496,740 A 2/1970 Borochaner
6,557,382 B1 * 5/2003 Koike ..... D06F 39/007 68/13 A
(Continued)

FOREIGN PATENT DOCUMENTS

EP 1085118 A2 3/2001
EP 2113602 A1 11/2009
EP 2657387 A1 10/2013

OTHER PUBLICATIONS

International Search Report and Written Opinion for International Application No. PCT/EP2017/051938, dated Mar. 29, 2017—11 pages.

*Primary Examiner* — Joseph L. Perrin
(74) *Attorney, Agent, or Firm* — RatnerPrestia

(57) ABSTRACT

A method to control a laundry washing machine having—an outer casing, a washing tub; a rotatable drum; a water softening device provided with ion exchanger agents designed to reduce the hardness degree of fresh water to be used during said washing program; a brine tank which is designed to supply, during a regeneration cycle, a prefixed amount of the brine to the water softening device for regenerating the ion exchanger agents; perform a waste-brine cleaning cycle for washing-out the waste brine solution contained in the water softening device and/or in the brine tank. The method controls the washing machine according to a washing program comprising one or more a washing phases, one or more rinse phases and one or more spin phases; and performs the regeneration cycle and the
(Continued)

waste-brine cleaning cycle during respective washing program phases, which are different one to the other.

17 Claims, 5 Drawing Sheets

(51) Int. Cl.
*D06F 39/08* (2006.01)
*D06F 35/00* (2006.01)

(52) U.S. Cl.
CPC ..... *D06F 35/006* (2013.01); *D06F 39/08* (2013.01); *D06F 39/083* (2013.01); *D06F 39/088* (2013.01)

(56) References Cited

U.S. PATENT DOCUMENTS

2014/0157835 A1* 6/2014 Del Pos ..... D06F 39/00 68/17 R
2014/0157836 A1* 6/2014 Zattin ..... D06F 39/028 68/17 R
2014/0165665 A1* 6/2014 Del Pos ..... D06F 39/02 68/200
2014/0165666 A1* 6/2014 Del Pos ..... D06F 39/028 68/200
2015/0107309 A1* 4/2015 Favaro ..... D06F 39/088 68/17 R
2015/0107310 A1* 4/2015 Del Pos ..... D06F 39/028 68/17 R
2015/0204005 A1* 7/2015 Favaro ..... D06F 39/028 68/17 R

* cited by examiner

HOME LAUNDRY WASHING MACHINE AND METHOD FOR CONTROLLING THEREOF

This application is a U.S. National Phase application of PCT International Application No. PCT/EP2017/051938, filed Jan. 30, 2017, which claims the benefit of European Application No. 16159779.4, filed Mar. 11, 2016, both of which are incorporated by reference herein.

FIELD OF THE INVENTION

The present invention concerns the field of laundry washing techniques. In particular, the present invention refers to a laundry washing machine wherein a water softening process is performed.

BACKGROUND OF THE INVENTION

Nowadays the use of laundry treating machines, both "simple" laundry washing machines (i.e. laundry washing machines which can only wash and rinse laundry) and washing-drying machines (i.e. laundry washing machines which can also dry laundry), is widespread.

In this respect, in the present description, where not stated differently, the term "laundry treatment machine" can be referred indiscriminately to a laundry washing machine, or to a laundry washing and drying machines, or to a laundry drying machine.

As is known, laundry treating machines generally comprise a detergent dispenser which is located inside a boxlike casing, immediately above a washing tub, and is structured for selectively feeding into the washing tub, according to the washing cycle manually-selected by the user, a given amount of detergent, softener and/or other washing agent suitably mixed with fresh water arriving from a water mains.

This type of home laundry washing machine further comprise a fresh-water supply circuit which is structured for selectively drawing fresh water from the water mains and channelling said fresh water to the detergent dispenser or directly to the washing tub; and an appliance control panel which is generally located on the front wall of the casing, above the laundry loading/unloading opening, and is structured for allowing the user to manually select the desired washing-program/cycle.

In addition to the above, some type of laundry washing machines have an internal water softening device which is located along the fresh-water supply circuit, and is structured to reduce, on command, the hardness degree of the fresh water channelled towards the detergent dispenser and the washing tub. The use of softened water during the washing cycle, in fact, significantly improves cleaning performances.

The water softening device comprises a ion exchanger which is internally provided with a given amount of ion-exchange agents, i.e. ion-exchange resins, which are capable of retaining the calcium and magnesium ions (Ca++ and Mg++) dissolved in the water flowing through the same water softening device, so as to reduce the hardness degree of the fresh water directed towards the detergent dispenser and the washing tub.

Since the water softening capabilities of the ion-exchange resins are used to quickly drop away after a number of washing program/cycles, the water softening device generally comprises a resin regeneration device, which is designed to perform regeneration cycles to regenerate the ion-exchange resins. More specifically, the regeneration unit generally comprise an internal reservoir of salt (NaCl) to be used for selectively producing some brine (i.e. salt water) which, during a regeneration cycle, is channeled into the ion exchanger to regenerate the ion-exchange resins located therein. Salt water, in fact, is able to remove from the ion-exchange resins during the regeneration cycle the calcium and magnesium ions previously combined/fixed to said resins.

The regeneration cycles take a certain period of time during which the water softening device cannot be used for supplying softening water to the washing tub. Thus, there is the need to coordinate the regeneration cycles during the washing programs in order to avoid interruptions/delays of the washing program phases, which may cause an increase of the duration/time of the washing program.

SUMMARY

Aim of the present invention is to control the activation of the regeneration cycle during the washing program without causing interruption/delays of time of the washing program.

In compliance with the above aims, according to the present invention there is provided a method to control a laundry washing machine comprising an outer casing, a washing tub placed inside said outer casing, a rotatable drum housed in axially rotatable manner inside the washing tub and structured for housing the laundry to be washed, a water softening device provided with ion exchanger agents designed to reduce the hardness degree of fresh water to be supplied to said washing tub, a brine tank which is designed to contain brine for regenerating said ion exchanger agents contained in said water softening device. The method controls said washing machine according to a washing program comprising: one or more washing phases, one or more rinse phases one or more spin phases; a regeneration cycle, in which a prefixed amount of the brine is supplied to said water softening device; a waste-brine cleaning cycle for washing-out the waste brine solution contained in said water softening device and/or in said brine tank; said method being characterized by performing alternately said regeneration cycle and said waste-brine cleaning cycle during respective washing program phases, which are different one to the other.

Preferably, the method comprises the step of performing said regeneration cycle and said waste-brine cleaning cycle during a first and a second washing program phases, respectively, wherein the first phase is performed before to perform the second phase.

Preferably, the regeneration cycle is performed during said washing phase.

Preferably, said washing phase comprises a number of washing sections comprising at least: a washing water load section, a washing water heating section, a washing maintenance section, a washing water drain section; said regeneration cycle being performed during one or more of said washing sections.

Preferably, said regeneration cycle is performed during one or more washing section/s following said water load section.

Preferably, said regeneration cycle is performed at the same time of said washing maintenance section.

Preferably, said regeneration cycle is exclusively performed at the same time of said washing maintenance section.

Preferably, said regeneration cycle is performed at the same time of said washing heating section.

Preferably, said regeneration cycle is exclusively performed at the same time of said washing heating section.

Preferably, said regeneration cycle is performed at the same time of said washing drain section.

Preferably, said regeneration cycle is exclusively performed at the same time of said washing drain section.

Preferably, said washing load section comprises the step of supplying fresh water to said tub; said regeneration cycle being performed at the same time of said washing load section.

Preferably, the regeneration cycle is performed between two successive washing sections of said washing phase.

Preferably, said waste-brine cleaning cycle is performed during a rinse phase following a washing phase.

Preferably, said waste-brine cleaning cycle is exclusively performed during a rinse phase following a washing phase.

Preferably, said rinse phase comprises a number of rinse sections comprising at least: a rinse water load section, a rinse maintenance section, a rinse water drain section; said waste-brine cleaning cycle being performed during one or more of said rinse sections.

Preferably, said waste-brine cleaning cycle is performed during said rinse water drain section of said rinse phase.

Preferably, said waste-brine cleaning cycle is exclusively performed during said rinse water to drain section of said rinse phase.

Preferably, said waste-brine cleaning cycle is performed during said rinse phase, immediately after or immediately before, said rinse water drain section.

Preferably, said waste-brine cleaning cycle is exclusively performed during said rinse phase, immediately after or immediately before, said rinse water drain section.

Preferably, said waste-brine cleaning cycle is performed during said rinse maintenance section and/or a rinse water drain section.

Preferably, said waste-brine cleaning cycle is exclusively performed during said rinse maintenance section and/or a rinse water drain section.

Preferably, said waste-brine cleaning cycle is performed during the first rinse phase following said washing phase.

Preferably, said waste-brine cleaning cycle is exclusively performed during the first rinse phase following said washing phase.

Preferably, the washing-out of the waste brine solution contained in said brine tank and the washing-out of said water softening device are performed simultaneously.

Preferably, the washing-out the waste brine solution contained in said brine tank and the washing-out of said water softening device is performed independently, one to the other.

Preferably, the method comprises the steps of performing a waste-brine cleaning cycle for washing-out of said ion exchanger agents and performing a waste-brine cleaning cycle for washing-out of said water softening device during respective rinse sections, which are different one to the other.

Moreover according to the present invention there is further provided a laundry washing machine comprising: an outer casing, a washing tub placed inside said outer casing, a rotatable drum housed in axially rotatable manner inside the washing tub and structured for housing the laundry to be washed, a water softening device provided with ion exchanger agents designed to reduce the hardness degree of fresh water to be supplied to said washing tub, a brine tank which is designed to contain brine for regenerating said ion exchanger agents contained in said water softening device, a washing circuit designed for washing-out the waste brine solution contained in said ion exchanger agents and/or in said brine tank, during a waste-brine cleaning cycle; a control to device configured to control said washing machine according to a washing program comprising: one or more washing phases, one or more rinse phases one or more spin phases; a regeneration cycle, in which a prefixed amount of the brine contained in said brine tank is supplied to said water softening device; a waste-brine cleaning cycle in which said washing circuit washes-out the waste brine solution contained in said water softening device and/or in said brine tank; said control device is further configured to control said washing circuit in order to alternately perform said regeneration cycle and said waste-brine cleaning cycle during respective phases of said washing program which are different, one to the other.

Preferably, said control device is further configured to perform said regeneration cycle and said waste-brine cleaning cycle during a first and a second washing program phases respectively, wherein the first phase is performed before the second phase.

Preferably, said control device are configured to perform said regeneration cycle during said washing phase.

Preferably, said washing phase comprises a number of washing sections comprising at least: a washing water load section, a washing water heating section, a washing maintenance section, a washing water drain section; said control device being configured to perform said regeneration cycle during one or more of said washing sections.

Preferably, said control device is configured to perform said regeneration cycle during one or more washing section/s following said water load section.

Preferably, said control device is configured to perform said regeneration cycle at the same time of said washing maintenance section.

Preferably, said control device is configured to perform said regeneration cycle at the same time of said washing heating section.

Preferably, the control device is configured to perform said regeneration cycle at the same time of said washing drain section.

Preferably, said washing load section comprises the step of supplying fresh water to said tub; said control device being configure to perform said regeneration cycle at the same time of said washing load section.

Preferably, said control device is configured to perform said regeneration cycle between two successive washing sections of the washing phase.

Preferably, said control device is configured to perform said waste-brine cleaning cycle during a rinse phase.

Preferably, said rinse phase comprises a number of rinse sections comprising at least: a rinse water load section, a rinse maintenance section, a rinse water drain section; said control device is configured to perform said waste-brine cleaning cycle during one or more of said rinse sections.

Preferably, said control device is configured to perform said waste-brine cleaning cycle during said rinse water drain section of said rinse phase.

Preferably, said control device is configured to perform said waste-brine cleaning cycle during said rinse phase, immediately after or immediately before, said rinse water drain section.

Preferably, said control device is configured to perform said waste-brine cleaning cycle during said rinse maintenance section and/or a rinse water drain section.

Preferably, said control device is configured to perform said waste-brine cleaning cycle during the first rinse phase following said washing phase.

Preferably, said control device is configured to perform the washing-out the waste brine solution contained in said brine tank and the washing-out of said water softening device simultaneously.

Preferably, said control device is configured to perform the washing-out the waste brine solution contained in said brine tank and the washing-out of said water softening device independently, one to the other.

Preferably, said control device is configured to perform a waste-brine cleaning cycle for washing-out of said ion exchanger agents and perform a waste-brine cleaning cycle for washing-out of said ion exchanger agents washing circuit during respective rinse sections, which are different one to the other.

BRIEF DESCRIPTION OF THE DRAWINGS

A non-limiting embodiment of the present invention will now be described, by way of example, with reference to the accompanying drawings, in which.

DETAILED DESCRIPTION OF EXEMPLARY EMBODIMENTS

Figure 2:
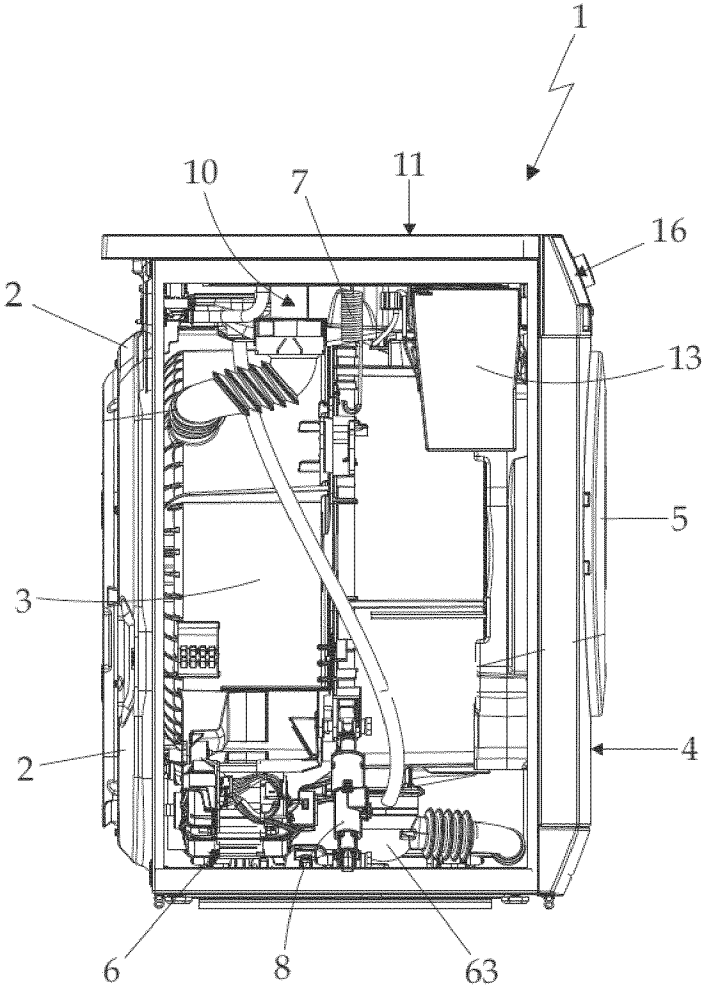
FIG. 2 is a schematic side view of the FIG. 1 laundry washing machine, with parts to removed for clarity.
Figure 1:
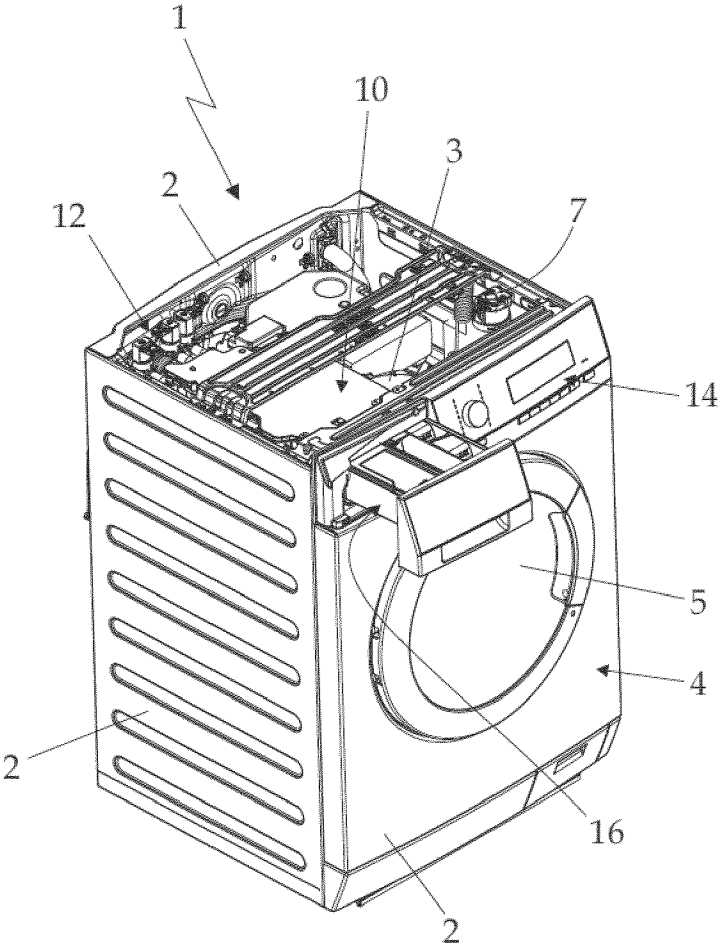
FIG. 1 is a schematic perspective view of a laundry washing machine realized in accordance with the teachings of the present invention, with parts removed for clarity.

With reference to FIGS. 1, and 2, reference number 1 indicates as a whole a laundry washing machine 1 which preferably basically comprises: a preferably substantially parallelepiped-shaped, outer boxlike casing 2 structured for resting on the floor; a preferably substantially horizontally-oriented, approximately cylindrical washing tub 3 which is arranged inside the casing 2 with the mouth directly facing a laundry loading/unloading pass-through opening realized in the front wall 4 of the outer casing 2; a substantially cylindrical, cup-shaped rotatable drum 20 (schematically illustrated in FIG. 3) which is structured for housing the laundry to be washed, and is fitted in axially rotatable manner inside the washing tub 3 with the concavity facing the front opening or mouth of washing tub 3, so as to be able to freely rotate about its longitudinal axis inside the washing tub 3; a porthole door 5 which is hinged to the front wall 4 of casing 2 so as to be movable/rotatable to and from a closing position in which the door 5 closes the laundry loading/unloading opening on front wall 4 for watertight sealing the washing tub 3; and an electrically-powered motor assembly 6 which is structured for driving into rotation the rotatable drum 20 about its longitudinal axis inside the washing tub 3.

In the example shown, in particular, the rotatable drum 20 of laundry washing machine 1 is preferably arranged inside the washing tub 3 with the drum rotation axis locally substantially coaxial to the longitudinal axis of washing tub 3, i.e. oriented substantially horizontally, and with the circular front opening or mouth of the drum 20 directly aligned and faced to the circular front opening or mouth of washing tub 3, so as to receive the laundry to be washed through the laundry loading/unloading opening realized on front wall 4.

The washing tub 3, in turn, is preferably suspended in floating manner inside the casing 2 via a suspension system that preferably, though not necessarily, comprises at least one, and preferably a couple of upper coil springs 7 connecting the upper portion of washing tub 3 to the top of casing 2, and preferably at least one, and preferably a couple of vibration dampers 8 connecting the bottom portion of washing tub 3 to the bottom of casing 2. Moreover the laundry washing machine 1 is preferably provided with a substantially cylindrical elastically-deformable bellows (not shown) which watertight connects the front mouth of washing tub 3 to the laundry loading/unloading opening realized on front wall 4 of casing 2.

Figure 3:
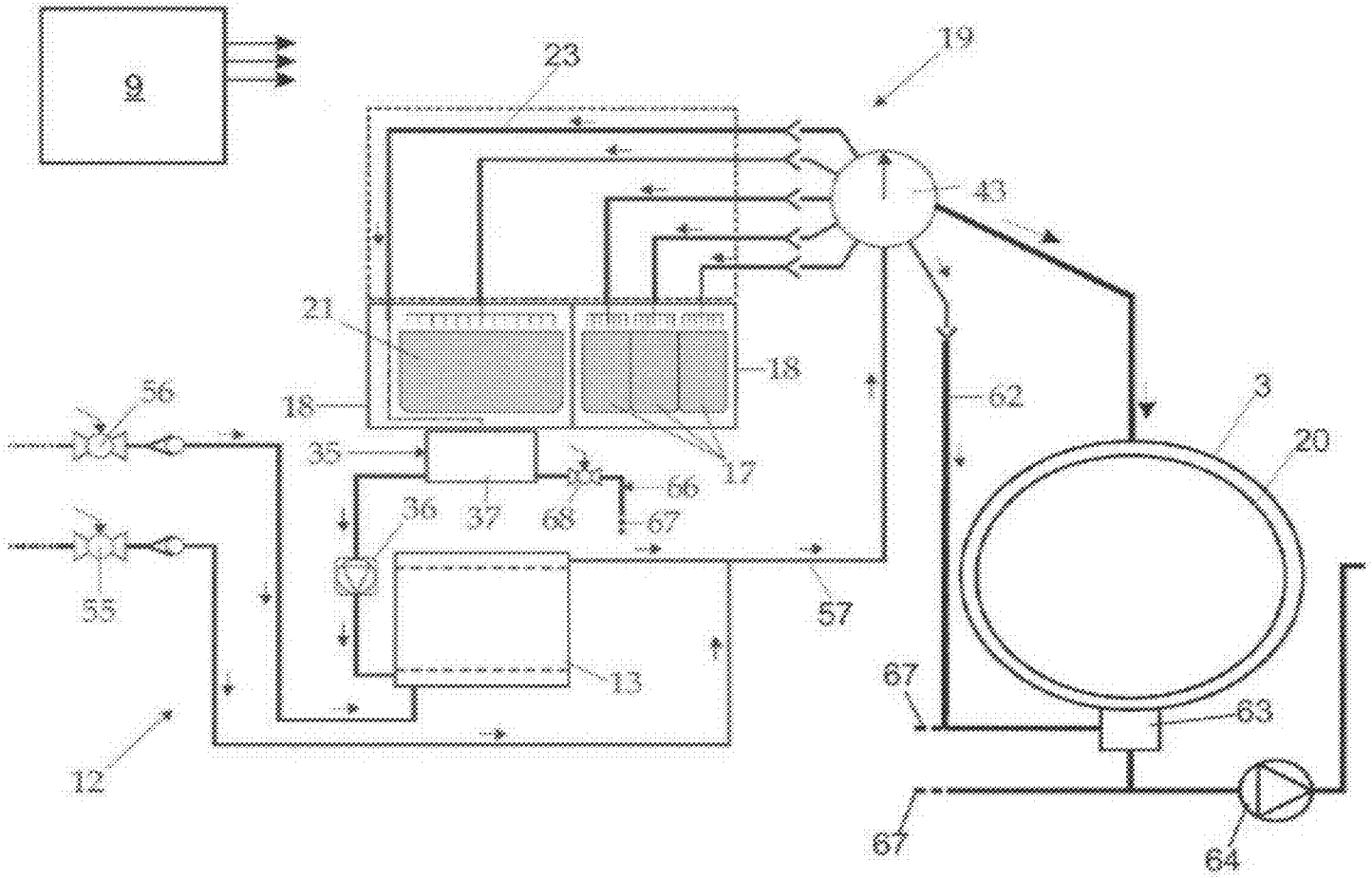
FIG. 3 is a schematic control circuit, which is configured to control the regeneration cycle, the resin washing cycle and the brine was of a laundry washing machine realized in accordance with the teachings of the present invention.

With reference to FIGS. 1, 2 and 3, the laundry washing machine 1 furthermore comprises: a detergent dispenser 10 which is located inside the casing 2 preferably above the washing tub 3 and preferably, though not necessarily, immediately underneath the upper worktop or top wall 11 of casing 2, and is structured for selectively feeding into the washing tub 3, according to the washing program manually-selected by the user, a given amount of detergent, softener and/or other washing agent suitably mixed with fresh water; a main fresh-water supply circuit 12 which is connectable directly to the water mains, and is structured for selectively channelling, according to the washing program manually-selected by the user, a flow of fresh water from the water mains to the detergent dispenser 10 or directly to the washing tub 3.

With reference to an exemplary embodiment illustrated in FIGS. 1, 2 and 3, the detergent dispenser 10 may comprise: a detergent drawer 16 which is provided with one or more detergent compartments 17 structured for being manually fillable with a given amount of detergent, softener or other washing agent. The detergent drawer 16 may be fitted/inserted in manually extractable manner into the drawer housing 18 which, in turn, is located/recessed inside the casing 2 above washing tub 3 (FIG. 1), and whose entrance is preferably located on front wall 4 of casing 2, above the laundry loading/unloading opening realized on the same front wall 4.

With reference to FIG. 1, the laundry washing machine 1 further comprise an appliance control panel 14 which may be preferably located on front wall 4 of casing 2, above the laundry loading/unloading opening and preferably also immediately beneath the upper worktop or top wall 11 of casing 2, and is structured to allow the user to manually select the desired washing program among a number of available washing programs.

With reference to FIGS. 2 and 3, the laundry washing machine 1 furthermore comprises an to internal water softening device 13 which is located inside the boxlike casing 2, along the fresh-water supply circuit 12 or the detergent dispenser 10, and is structured for selectively reducing, during one or more phases of the washing program, the hardness degree of the fresh water that fresh-water supply circuit 12 channels towards detergent dispenser 10 or washing tub 3. According to an exemplary embodiment illustrated in FIG. 3, the water softening device 13 may comprise a closed container which has a water inlet and a water outlet fluidically connected to the fresh-water supply circuit 12 and/or the detergent dispenser 10 so as to be crossed by the fresh/tap water directed towards the washing tub 3. The closed container may be furthermore filled with a given amount of ion-exchange resins capable of retaining the calcium and magnesium ions (Ca++ and Mg++) dissolved in the water flowing through the same container, so as to reduce the hardness degree of the tap water directed towards the washing tub 3. According to an exemplary embodiment illustrated in FIG. 3, the water softening device 13 may be located inside the boxlike casing 2 adjoined to the detergent dispenser 10, and may be fluidically connected to detergent dispenser 10 so as to be crossed by the fresh water flowing towards the washing tub 3 via the same detergent dispenser 10.

The laundry washing machine 1 further comprises a brine reservoir 35 which is dimensioned to contain brine (salt water) and is configured to supply, on command, a determined amount of brine to said water softening device 13 for performing the regeneration cycle of the ion-exchange resins located inside the same water softening device 13.

The laundry washing machine 1 further comprises a regeneration-agent reservoir, i.e. a regeneration-agent compartment 21, which is located/recessed inside the boxlike casing 2 and is structured for being manually fillable with a given amount of consumable salt grains (NaCl) or other regeneration agent. As illustrated in the example of FIG. 3, the brine reservoir 35 may be dimensioned to contain a given amount of brine preferably greater than 100 ml (milliliters) and fluidically communicates with the regeneration-agent compartment 21 for receiving and accumulating the brine coming out from said regeneration-agent compartment 21. The brine reservoir 35 may comprise a closed tank 37, preferably a small and unpressurized tank, communicating with the regeneration-agent compartment 21 via one or more pipes in order to receive the brine from said regeneration-agent compartment 21.

According to a preferred embodiment illustrated in the schematic example of FIG. 3, the laundry washing machine 1 may further comprise an electrically-powered pump assembly 36 having the suction connected to the brine reservoir 35 and the delivery connected to the water softening device 13, thus to be able to selectively pump the brine from the brine reservoir 35 to the water softening device 13. Pump assembly 36 preferably comprises an electrically-powered volumetric pump. It should be understood that the present invention is not limited to the pump assembly designed to pump the brine to the water softening device 13 during the regeneration cycle, but it may envisage other alternative and/or a less sophisticated embodiment in which, for example, the pump assembly 36 could be replaced by an electrically-operated on-off valve which is interposed between the brine reservoir 35 and the water softening device 13, and is capable of controlling the flow of brine by gravity towards the water softening device 13. The brine reservoir 35 may be preferably dimensioned to contain a maximum amount of brine preferably overapproximating the whole amount of brine to be pumped into the internal water softening device 13 for performing the regeneration cycle of the ion-exchange resins located inside the same water softening device 13

As illustrated in the schematic example of FIG. 3, the regeneration-agent compartment 21 may be preferably arranged on detergent drawer 16, beside one or more detergent compartments 17, so that both detergent compartment/s 17 and regeneration-agent compartment 21 are allowed to almost contemporaneously come out from the front wall 4 of casing 2 when detergent drawer 16 moves from the retracted position to the extracted position. Preferably the regeneration-agent compartment 21 may be moreover dimensioned to accommodate/contain an amount of consumable salt (NaCl) or other regeneration-agent sufficient for performing a plurality of regeneration cycles of the ion-exchange resins of the water softening device 11. It should be understood that the present invention is not limited to the above disclosed regeneration-agent compartment 21 placed in the detergent drawer 16, but it could envisage of placing the regeneration-agent compartment 21 outside of the detergent drawer 16. In other words the regeneration-agent compartment 21 may be placed in a relative drawer (not illustrated) coupled with the casing 2.

According to a preferred embodiment illustrated in the schematic example of FIG. 3, the laundry washing machine 1 may furthermore comprise a hydraulic circuit 19 which is connected to the fresh-water supply circuit 12, and is structured for channelling the fresh water of the water mains into the regeneration-agent compartment 21, so as to dissolve some of the salt grains contained into the same regeneration-agent compartment 21 and form the brine. For example, the hydraulic circuit 19 may be connected to the fresh-water supply circuit 12 for receiving the fresh water of the water mains, and may be structured for pouring the fresh water arriving from the water mains into the regeneration-agent compartment 21 of detergent drawer 16 or into any one of detergent compartments 17. The poured fresh water serves to dissolve some salt grains contained into the regeneration-agent compartment 21 to form the brine.

According to the example illustrated in FIG. 3, the hydraulic circuit 19 may be further structured for selectively channelling the fresh water of the water mains directly to the brine reservoir 35 bypassing the regeneration-agent compartment 21 of detergent drawer 16. In other words, the hydraulic circuit 19 may be directly connected to the fresh-water supply circuit 12 for receiving the fresh water of the water mains, and is suitably structured for selectively and alternatively channelling the fresh water arriving from the water mains towards any one of detergent compartments 17, or towards the brine reservoir 35 by a hose/pipe 23 bypassing the regeneration-agent compartment 21 of detergent drawer 16 so as to selectively completely fill up the brine reservoir 35 with fresh water. As it will be disclosed hereinafter in detail, the hydraulic circuit 19 is controlled to supply fresh water directly to the brine reservoir 35 for washing up the same brine reservoir 35 in order to clean it from residual brine/salt.

According to an embodiment illustrated in FIG. 3, the hydraulic circuit 19 may comprise, for example: an electrically-operated, water distributor 43 which is fluidically connected to the fresh-water supply circuit 12 and/or to the internal water softening device 13 for receiving a flow of unsoftened or softened fresh water, and is suitably structured to selectively channel, on command, the unsoftened fresh water arriving from fresh-water supply circuit 12 or the softened fresh water arriving from water softening device 13, towards: the regeneration-agent compartment 21, or the brine reservoir 35, or the detergent compartments 17 or the water softening device 13, or the washing tub 3.

According to an embodiment illustrated in FIG. 3, the electrically-operated, water distributor 43 of the hydraulic circuit 19 is further configured to selectively channel, on command, any kind of water that enters into the same hydraulic circuit 19, to a water drain line 62 that braches off from the hydraulic circuit 19 and preferably ends into a drain sump 63 of washing tub 3, or even directly into the suction of an electric pump 64 that is controlled in order to drain the waste water or washing liquor outside the laundry washing machine 1. In the schematic example illustrated in FIG. 3, the water drain line 62 may preferably comprises a hosepipe or other piping, that fits directly into the drain sump 63 of washing tub 3.

According to an exemplary embodiment illustrated in FIG. 3, the electrically-operated, water distributor 43, may, preferably consists in a discrete, electrically-operated, flow-diverter module which has a water inlet which directly communicates with the water softening device 13 for directly receiving softened fresh water, and preferably also with the fresh-water supply circuit 12 for also directly receiving unsoftened fresh water; and a number of water outlets respectively communicating with the regeneration-agent compartment 21, the brine reservoir 35 and the detergent compartments 17, the water softening device 13. Preferably the electrically-operated, flow-diverter module may furthermore internally accommodates a rotatable flow diverter (not shown) which is capable of channeling, according to its angular position, the water entering into flow-diverter module via the water inlet towards any one of the water outlets of the same flow-diverter module 43. In addition to the above, the flow-diverter module 43 preferably also comprises an electrically-operated motor assembly (not shown) which is mechanically connected to the rotatable flow diverter for controlling the angular position of the flow diverter, and optionally also an electronic control unit (not shown) which is structured to directly power and control the electrically-operated motor assembly according to electric signals arriving from an electronic control unit 9 of the laundry washing machine 1. As an alternative, the electrically-operated, water distributor 43 may consists in a valve assembly comprising a number of electrically-operated on-off valves capable of selectively channeling the unsoftened fresh water arriving from fresh-water supply circuit 12 or the softened fresh water arriving from water softening device 13, towards the regeneration-agent compartment 21 the brine reservoir 35, the water softening device 13 and the detergent compartments 17.

With reference to an example illustrated in FIG. 3, the internal water softening device 13 may be preferably fluidically connected to the hydraulic circuit 19 so as to be crossed by the fresh water that flows inside the hydraulic circuit 19 towards the detergent compartments/s 17 of detergent drawer 16, and optionally towards the regeneration-agent compartment 21 or towards brine reservoir 35, so that the hardness degree of the tap water supplied/poured at least into any one of the detergent compartments 17 of detergent drawer 16 is significantly reduced.

According to a preferred embodiment illustrated in FIG. 3, the fresh-water supply circuit 12 of laundry washing machine 1 may preferably comprise two independent electrically-operated on-off valves 55 and 56, each separately connectable to the water mains. The electrically-operated on-off valve 55 may be directly connected to a main water inlet of the hydraulic circuit 12 via a first connecting tube 57 or other piping, thus to channel the fresh water of the water mains directly to the hydraulic circuit 12, i.e. the flow-diverter module 43, bypassing the internal water softening device 13. The main water of the inlet hydraulic circuit 12 may be also fluidically connected to an outlet of the water softening device 13 in order to receive the softened water. In the illustrated example the outlet of the water softening device 13 is fluidically connected to the main water inlet of inlet hydraulic circuit 12 by a part/section of the first connecting tube 57. The electrically-operated on-off valve 56 of the fresh-water supply circuit 12 instead may be directly connected to a inlet of the water softening device 13 to channel the fresh water of the water mains to the internal water softening device 13.

With reference to FIG. 3, preferably the brine reservoir 35 may be optionally provided with a water drain line 66 that braches off from brine tank 37 and ends into the drain sump 63 of washing tub 3, or even directly into the suction of the electric pump 64 that drains the waste water or washing liquor outside the laundry washing machine 1. In the example shown, the water drain line 66 preferably comprises: a hosepipe 67 or other piping, that branches off from the bottom of brine tank 37 and fits directly into the drain sump 63 of washing tub 3; and an electrically-operated, on-off valve 68 which is arranged along hosepipe 67 for controlling the outflow of the water or brine from brine tank 37 towards the drain sump 63.

Regarding the electronic control unit 9, it may be configured to controls operation of the laundry washing machine 1 according to a washing program selected by the user among a plurality of washing programs preferably memorized in memory device (not illustrated) contained, for example, in the same electronic control unit 9.

It should be understood that in the present description, with washing program, it will be understood a laundry washing cycle comprising one or more washing phases, one or more rinse phases, and one or more a spin phases.

It is further pointed out that the washing phases, the rinse phases, and the spin phases are part of the washing program and that the washing phases and the rinse phases comprise, in turn, a number of sub-phases, afterwards called "washing sections", and "rinse sections", respectively.

Preferably, the washing phase of the washing program may comprise, a washing loading water section wherein detergent mixed with a predetermined amount of softened or unsoftened water are supplied to the tub 3; a washing heating section wherein the water contained in the tub 3, i.e. cold water, is heated according to a prefixed washing temperature; a washing maintenance section, wherein the drum 4 is rotated at determined washing rotational speed/s, preferably in alternative clockwise and anticlockwise directions, for tumbling the laundry for detergent action, and a washing drain section wherein the waste washing water contained in the tub 3 is drained out of the machine 1.

Regarding the rinse phase, it is performed after the laundry wash phase and may comprise a rinse water loading section (loading a prefixed rinse amount of unsoftened or softened water into the washing tub 3), a rinse maintenance section, wherein the drum 20 is rotated at predetermined rinse-speed/s for tumbling the laundry, a rinse drain section, wherein the waste rinse water is drained out of the washing machine 1, and a rinse spin section, wherein the drum 20 is rotated at a prefixed rinse spin speed. Regarding the spin phase, it comprise the step of accelerating the drum 20 in order to reach a prefixed high spin speed, for example greater than rinse-spin speed.

According to the present invention, the washing program is configure in order to incorporate a regeneration cycle and a waste-brine cleaning cycle. As it will be disclosed hereinafter in detail, during the waste-brine cleaning cycle, the machine 1 rinses/washes up the waste brine solution and/or salt residues contained in the water softening device 13 and/or the waste brine solution and/or salt residues contained in the brine tank 37 and drains such waste brine solution/salt residues outside of the machine 1. In other words, during the waste-brine cleaning cycle, the control unit 9 controls the machine 1 for washing out the exchanged hardness liquid produced to during the regeneration cycle both from the water softening device 13 and the brine tank 37, and drains the exchanged hardness liquid out of the washing machine 1.

As it will be disclosed in detail hereinafter, the present invention is essentially based on the idea of performing the regenerating cycle and the waste-brine cleaning cycle during respective washing program phases, which are different one to the other. The applicant has found that performing the regenerating cycle and the waste-brine cleaning cycle during different washing program phases, has the conveniently technical effect of avoiding any interruptions/delays of the washing program.

Figure 4:
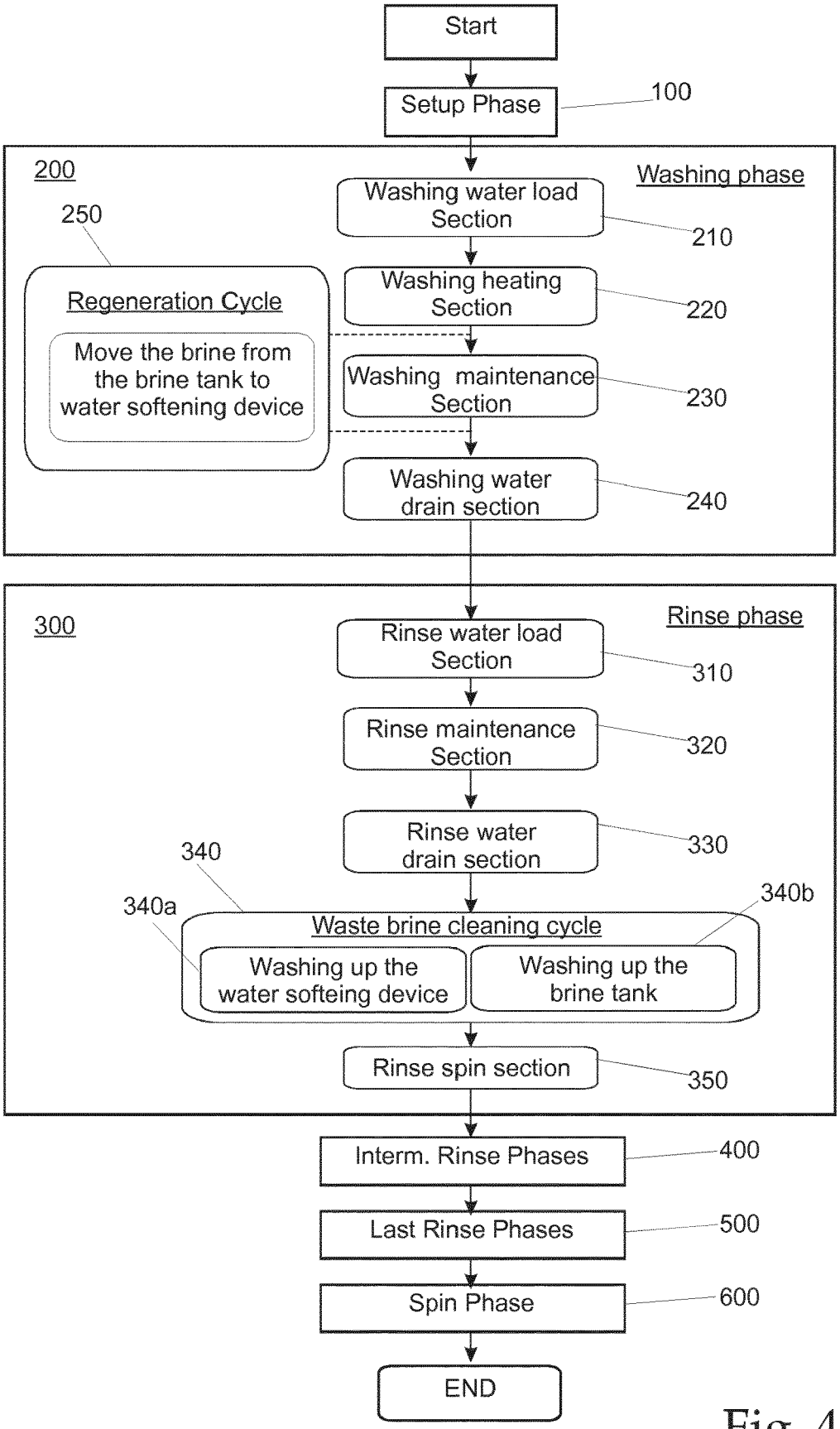
FIG. 4 is a flow chart of the operation performed by the control circuit illustrated in FIG. 3.

According to a preferred embodiment illustrated in FIG. 4, the washing program may be setup so that the regeneration cycle may be conveniently performed during a first phase, while the water brine cycle may be conveniently performed in a second phase following the first phase.

According to an exemplary embodiment which will be hereinafter disclosed in detail the washing program is configured so that the regeneration cycle is conveniently incorporated in the washing phase, whereas the waste-brine cleaning cycle is conveniently incorporated in a rinse phase following the washing phase.

According to a preferred embodiment illustrated in FIG. 3, when a regeneration cycle has to be performed, the control unit 9 may operate the hydraulic circuit 19 (i.e. the flow-diverter module 43 in the shown example), so as to channel, towards the regeneration-agent compartment 21, the softened or unsoftened fresh water entering into the hydraulic circuit 19, and then may open for a short time either the on-off valve 55 or the on-off valve 56 of the fresh-water supply circuit 12, so as to supply/pour a given amount of fresh water, for example 300 cm3 (cubic centimeters) of fresh water, into the regeneration-agent compartment 21. The softened or unsoftened fresh water contained into the regeneration-agent compartment 21 dissolves a great amount of salt grains and forms the brine. The brine formed into the regeneration-agent compartment 21 is supplied to (falls into) brine tank 37 wherein accumulates. Then, if brine tank 37 has room for other brine, the control unit 9 may open again for a short time either the on-off valve 55 or the on-off valve 56 of fresh-water supply circuit 12, so as to supply/pour some more fresh water, for example 250 cm3 (cubic centimeters) of fresh water, into the regeneration-agent compartment 21, so as to form a 250 cm3 of brine that, again, moves into brine tank 37. Sequential to quantum supplying of fresh water into the regeneration-agent compartment 21 may continue until brine reservoir, or better brine tank 37, is completely filled with brine, i.e. contains an amount of brine sufficient for performing the whole regeneration cycle of the ion-exchange resins contained into water softening device 13. When brine tank 37 is completely filled with brine, the control unit 9 may activate the pump assembly 36 to move at a time the whole brine from brine tank 37 to water softening device 13, so as to fill up the water softening device 13 with brine. In other words, when brine tank 37 is completely filled with brine, the control unit 9 activates pump assembly 36 so as to substantially empty the brine reservoir 35 into the water softening device 13.

When a "loading of water" has to be performed (water loading section), the control unit 9 may operate the water supply circuit 12, the hydraulic circuit 19, based on the kind of water, softened or unsoftened, to be supplied. When unsoftened water has to be loaded to the tub 3, the control unit 9 open the valve 55 and operates the hydraulic circuit 12 so as to channel, directly towards the tub 3, the fresh water entering into the drawer flush circuit 19. Vice versa, when softened water has to be loaded into the tub 3, the control unit 9 may open the valve 56 so as to channel the fresh water entering into the water softening device 13 and operates the hydraulic circuit 12 so as to channel directly towards the tub 3 the softened water provided by the water softening device 13. It should be understood that during the "loading of water" the fresh water may also enters the detergent dispenser 10 in order to feed into the washing tub, a given amount of detergent, softener and/or other washing agent suitably mixed with the fresh water.

When a "waste-brine cleaning cycle" has to be performed, the control unit 9 may operate the hydraulic circuit 19 so as to channel, directly towards the brine tank 37 and bypassing the regeneration-agent compartment 21, the fresh water entering into the hydraulic circuit 19, and then opens the on-off valve 55 of the fresh-water supply circuit 12 thus to supply/pour a given amount of fresh water into the brine reservoir 35. The fresh water channelled into the brine reservoir 35 serves for rinsing/washing out the same brine reservoir 35 from the waste brine solution. According to the exemplary embodiment illustrated in FIG. 3, during the waste-brine cleaning cycle, the control unit 9 may keep the on-off valve 55 open until brine tank 37 is completely filled with fresh water. After having filled up brine tank 37 with fresh water, the control unit 9 may operate the hydraulic circuit 9, i.e. activates the flow-diverter module 43, in order to put the water to inlet of flow-diverter module 43 in direct communication with drain line 62 and preferably activates the electric-pump assembly 36 to move at a time the whole waste rinse water from brine tank 37 to water softening device 13, so as to substantially empty the brine reservoir 35 and at same time push the brine out of water softening device 13. The brine coming out from the water outlet of water softening device 13 preferably enters into the flow-diverter module 43 and is immediately channeled to the drain line 62 thus to leave as soon as possible the laundry washing machine 1. During the waste-brine cleaning cycle, the control unit 9 may fill up brine reservoir 35 with fresh water and subsequently move said fresh water into the water softening device 13 several times, thus to repeatedly wash up/rinse both the brine reservoir 35 and the water softening device 13 to clean and remove any salt deposit inside both components.

It should be understood that according to a different embodiment of the present invention, the control unit 9 may be configured to separately perform the waste-brine cleaning cycles in the brine reservoir 35 and into the water softening device 13. In other words, the control unit 9 may be configured to operate the machine 1 in order to perform a first waste-brine cleaning cycle in the brine reservoir 35 and a second first waste-brine cleaning cycle in the water softening device 13.

For example the control unit 9 may perform a first waste-brine cleaning cycle in the brine reservoir 35 by opening for a short time the electrically-operated, on-off valve 68 of drain line 66, thus to empty the brine tank 37 directly into the drain sump 63 or into the pump 64 without affecting the water softening device 13.

Moreover, the control unit 9 may perform the second waste-brine cleaning cycle in the water softening device 13 by keeping the on-off valve 56 open in order to supply fresh water to the water softening device 13 and operating the hydraulic circuit 19, i.e. activating the flow-diverter module 43, in order to put the water inlet of flow-diverter module 43 in direct communication with drain line 62. In this case the waste brine solution coming out from the water outlet of water softening device 13 enters into the flow-diverter module 43 and is immediately channeled to the drain line 62. When washing up/rinsing of brine reservoir 35 and water softening device 13 is completed, the control unit 9 may operates the hydraulic circuit 19, i.e. the flow-diverter module 43, so as to channel the softened or unsoftened fresh water arriving to the hydraulic circuit 19 towards any one of the detergent compartments 17 of detergent drawer 16, thus to continue the washing cycle.

Referring now to FIG. 4, a flow chart of a method for controlling the washing machine 1 is illustrated. It should be understood that the sequence of steps illustrated in the FIG. 4 for this method is for illustrative purposes only, and is not meant to limit the method in any way as it is understood that the steps may proceed in a different logical order or additional or intervening steps may be included without detracting from the invention. The method may be implemented in any suitable manner, such as automatically, or cycle of operation or as a phase of an operation cycle of the washing machine 1.

At the START block, the method starts by assuming that the user has placed one or more laundry items to be washed within the drum 20, selected a laundry washing program by the control panel 14, and inputted a command to start the selected washing program.

At block 100, the electronic control unit 9 controls the washing machine 1 in order to perform a setup phase. Preferably, during the setup phase, the control unit 9 may detect, for example, some washing parameters associated with the laundry load, and set-up some cycle control quantities to be used to control the machine 1 during the washing program. For example, during the setup phase, the control unit 9 may determine the weight of the laundry load, and may set the water temperature and/or amount and/or kind of water, i.e. unsoftened or softened, to be used during the phases of the selected washing program based on the determined weight.

After completing the setup phase, the control unit 9 starts to perform the washing phase (block 200). In detail, during the washing phase, the control unit 9 controls the washing machine 1 in order to perform, as above disclosed: the washing water load section (block 210), the washing heating section (block 220) the washing maintenance section (block 230) and the washing water drain section (block (240). According to the present invention, during the washing phase, the control unit 9 further control the washing machine 1 in order to perform the regeneration cycle (block 250) according to what above disclosed. The control unit 9 may be configured to perform the regeneration cycle during the execution of one or more sections of the washing phase. According to the embodiment illustrated in FIG. 4, the control unit 9 may be configured to conveniently perform the regeneration cycle during the washing maintenance section.

Figure 5:
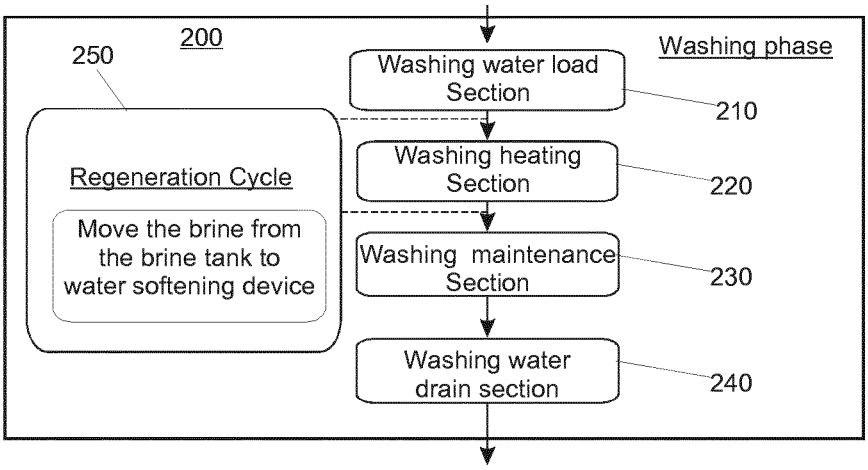
FIGS. 5-10 are variants of the operating of the method illustrated in the flow chart of FIG. 4.
Figure 6:
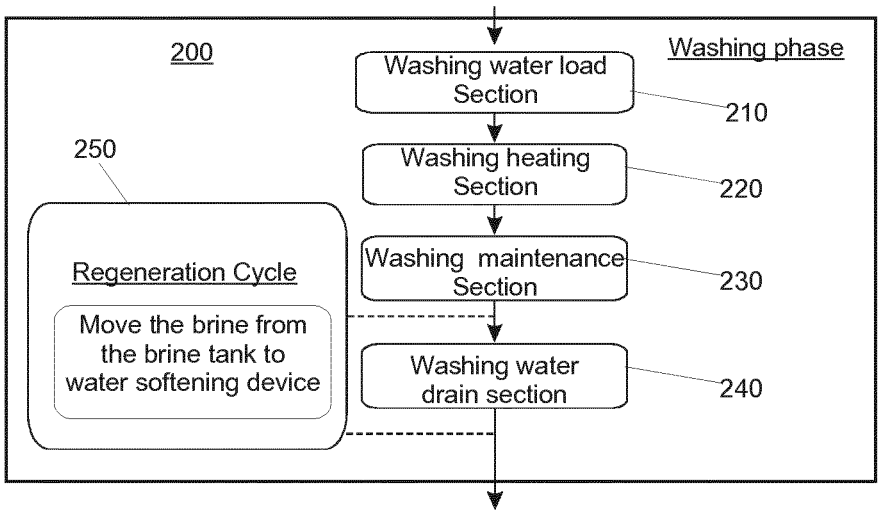
Figure 7:
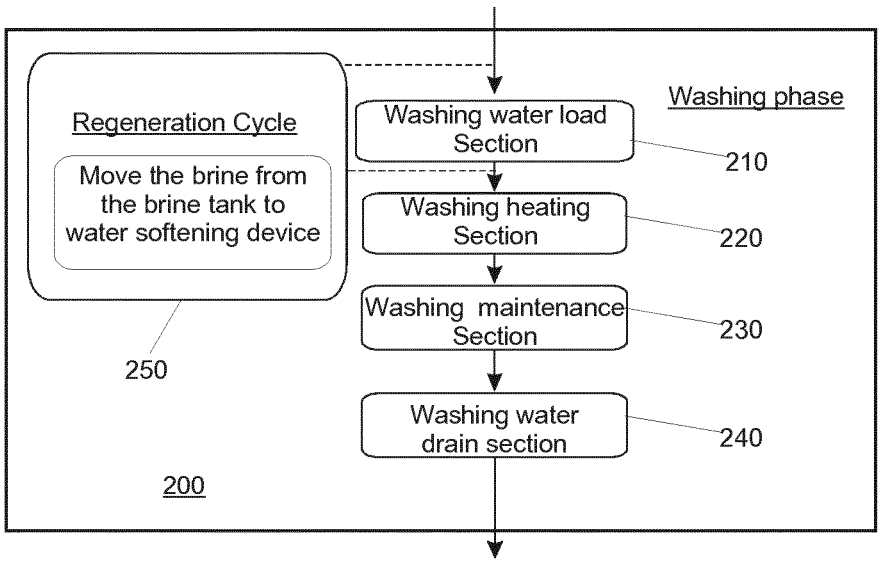

However, it should be understood that the present invention is not limited to carry out the regeneration cycle during the washing maintenance section. Indeed, according to further to embodiments, the control unit 9 may be configured to conveniently perform the regeneration cycle during the washing heating section, or during the drain section, or during the washing load water section. The examples illustrated in FIGS. 5, 6 and 7 contain blocks 210-250 identical to blocks 210-250 illustrated in FIG. 4 made according to the preferred embodiment, wherein the embodiments differ from the first embodiment on the phase in which the regeneration cycle is performed.

It is further pointed out that the present invention is not limited to the fact that the regeneration cycle is performed during the execution of the sections of the washing phase. Indeed, according to a different embodiment (not illustrated) the regeneration cycle may be performed between two consecutive sections of the washing phase. For example the regeneration cycle may be incorporated/performed between the washing water load section and the washing heating section, or between the washing heating section and the washing maintenance section, or between the washing maintenance section and the washing drain section.

With reference to a preferred embodiment illustrated in FIG. 4, after completing the washing phase, the control unit 9 starts controlling the washing machine 1 according to the section programmed in the first rinse phase of the selected washing program (block 300). Preferably, during the first rinse phase, the control unit 9 may perform a rinse water load section (block 310), a rinse maintenance section (block 320), and a rise water drain section (block 330). According to a preferred embodiment, during the rinse phase, the control unit 9 further control the washing machine 1 in order to perform the waste brine cleaning cycle (block 340) during one or more rinse sections. Preferably the waste brine cleaning cycle is conveniently performed after or during the rinse water drain section (block 330). During the waste brine cleaning cycle, the control unit 9 may control the machine in order to washing out the water softening device 13 (block 340*a*) and/or washing out the brine tank 37 (block 340*b*).

Figure 8:
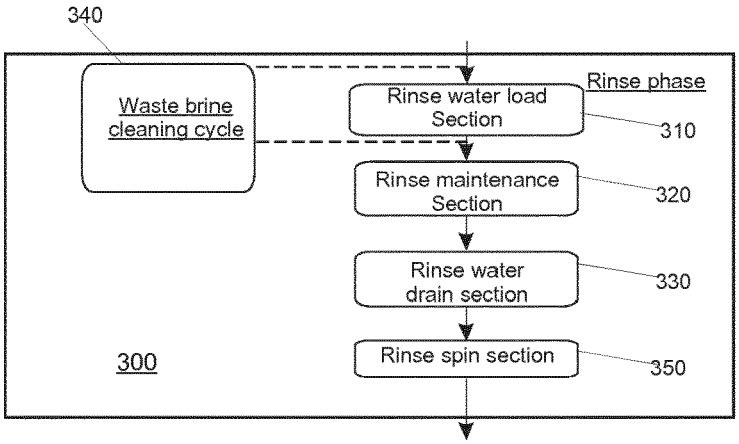
Figure 9:
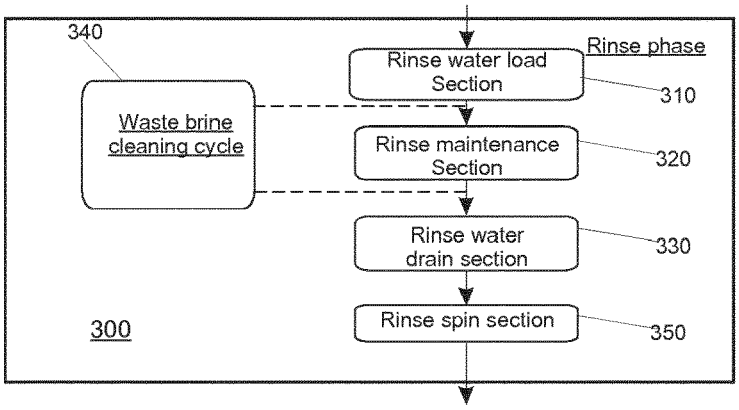

However, it should be understood that the present invention is not limited to carry out the waste brine cleaning cycle during after or during the rinse water drain section. Indeed, according to further embodiments, the control unit 9 may be configured to conveniently perform the waste brine cleaning cycle during the rinse water load section (for example if the water to be loaded is fresh/unsoftened water), or during the rinse maintenance section. The examples illustrated in to FIGS. 8 and 9 contain blocks 310-350 identical to blocks 310-350 illustrated in FIG. 4 made according to the preferred embodiment, wherein the embodiments differ from the first embodiment on the phase in which the waste brine cleaning cycle is carried out.

Figure 10:
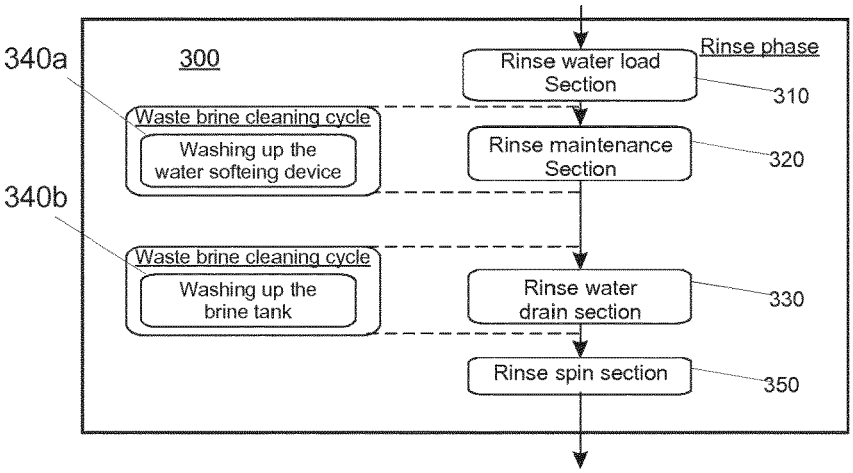

Moreover, according to a further embodiment, the control unit 9 may be configured to washing up the water softening device 13 and washing up the brine tank 37 in two relative different phases. For example, according to the embodiment illustrated in FIG. 10, the control unit 9 performs the waste brine cleaning cycle for washing up the water softening device 13 during a rinse section, i.e. a rinse maintenance section, and afterwards, performs the waste brine cleaning cycle for washing up the brine tank 37 during the rinse water drain section.

It is understood that control unit 9 may be configured to perform the waste brine cleaning cycle based on the kind of water softened or unsoftened to be used in the phases of the washing program. For example if the washing program is configured to use the softened water only during the last rinse phase, and supply fresh water in the other previous phases, it may set up the execution of the waste brine cleaning cycle in any of the preceding rinse phases.

With reference to FIG. 4, after completing the rinse water drain section and the waste brine cleaning cycle, the control unit may perform the rinse spin section (block 350).

After completing the rinse phase, the control unit 9 may preferably perform in sequence one or more intermediate rinse phases (block 400), a last rinse phase (block 500) and a last spin phase (block 600).

It has thus been shown that the present invention allows all the set objects to be achieved.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A method to control a laundry washing machine comprising an outer casing, a washing tub placed inside said outer casing, a rotatable drum housed in axially rotatable manner inside the washing tub and structured for housing the laundry to be washed, a water softening device provided with ion exchanger agents designed to reduce the hardness degree of fresh water to be supplied to the washing tub, and a brine tank configured to contain brine for regenerating the ion exchanger agents contained in the water softening device, the method comprising:

performing a washing cycle including at least:

a washing phase, a rinse phase, and a spin phase, performing a regeneration cycle, in which a prefixed amount of the brine is supplied to the water softening device during a first phase of the washing cycle, and draining the brine from the water softening device; and after draining the brine from the water softening device, and while performing a second phase of the washing cycle that is different than the first phase of the washing cycle, perform a waste-brine cleaning cycle by injecting water into the water softening device and/or in the brine tank and draining the injected water from the water softening device and/or in the brine tank to wash out the waste brine solution remaining in the water softening device and/or in the brine tank from the first washing phase.

2. The method according to claim 1, wherein the first washing phase is performed before the second washing phase.

3. The method according to claim 1, wherein the regeneration cycle is performed during the washing phase.

4. The method according to claim 1, wherein the washing phase includes a number of washing sections comprising at least: a washing water load section, a washing water heating section, a washing maintenance section, a washing water drain section; and the regeneration cycle is performed during one or more of the washing sections.

5. The method according to claim 4, wherein the regeneration cycle is performed between two successive washing sections of the washing phase.

6. The method according to claim 1, wherein the waste-brine cleaning cycle is performed during a rinse phase following a washing phase.

7. The method according to claim 1, wherein the rinse phase comprises a number of rinse sections comprising at least: a rinse water load section, a rinse maintenance section, a rinse water drain section; the waste-brine cleaning cycle is performed during one or more of the rinse sections.

8. Method according to claim 1, wherein the washing-out of the waste brine solution contained in the brine tank and the washing-out of the water softening device are performed simultaneously.

9. The method according to claim 1, wherein the washing-out the waste brine solution contained in the brine tank and the washing-out of the water softening device are performed independently.

10. The method according to claim 1, wherein the rinse phase comprises a plurality of rinse sections, and the method further comprises performing a waste-brine cleaning cycle for washing-out of the ion exchanger agents during a first rinse section, and performing a waste-brine cleaning cycle for washing-out of the water softening device during a second rinse section, the first rinse section being different from the second rinse section.

11. The method according to claim 1, wherein the washing phase comprises one or more washing phases, the rinse phase comprises one or more rinse phases, and the spin phase comprises one or more spin phases.

12. A laundry washing machine comprising:

an outer casing;

a washing tub placed inside the outer casing;

a rotatable drum housed in axially rotatable manner inside the washing tub and structured for housing the laundry to be washed;

a water softening device provided with ion exchanger agents designed to reduce the hardness degree of fresh water to be supplied to the washing tub;

a brine tank which is designed to contain brine for regenerating the ion exchanger agents contained in the water softening device;

a washing circuit designed for washing-out the waste brine solution contained in the water softening device and/or in the brine tank, during a waste-brine cleaning cycle; and a control device configured to control the washing machine according to a washing program having:

a washing cycle including at least:

a washing phase, a rinse phase, and a spin phase, a regeneration cycle, in which a prefixed amount of the brine contained in the brine tank is supplied to the water softening device during a first phase of the washing cycle, and draining the brine from the water softening device, and a waste-brine cleaning cycle, performed after draining the brine from the water softening device, and during a second phase of the washing cycle that is different than the first phase of the washing cycle, the waste-brine cleaning cycle including injecting water into the water softening device and/or in the brine tank and draining the injected water from the water softening device and/or in the brine tank to wash out the waste brine solution remaining in the water softening device and/or in the brine tank from the first washing phase.

13. The laundry washing machine according to claim 12, wherein the first washing program phase is performed before the second washing phase.

14. The laundry washing machine according to claim 12, wherein the control device is configured to perform the regeneration cycle during the washing phase.

15. The laundry washing machine according to claim 12, wherein the control device is configured to perform the waste-brine cleaning cycle during the rinse phase.

16. The laundry washing machine according to claim 12, wherein the control device is configured to perform a waste-brine cleaning cycle for washing-out of the ion exchanger agents and perform a waste-brine cleaning cycle for washing-out of the water softening device simultaneously.

17. The laundry washing machine according to claim 12, wherein the washing phase comprises one or more washing phases, the rinse phase comprises one or more rinse phases, and the spin phase comprises one or more spin phases.

* * * * *